US008162243B2

(12) United States Patent
Wenthe et al.

(10) Patent No.: US 8,162,243 B2
(45) Date of Patent: Apr. 24, 2012

(54) FIBER FEEDER

(75) Inventors: Richard Wenthe, Salina, KS (US); Eric Johnson, Salina, KS (US); Monty Oberle, Salina, KS (US)

(73) Assignee: Arr-Maz Products, L.P., Mulberry, FL (US)

( * ) Notice: Subject to any disclaimer, the term of this patent is extended or adjusted under 35 U.S.C. 154(b) by 44 days.

(21) Appl. No.: 12/821,342

(22) Filed: Jun. 23, 2010

(65) Prior Publication Data

US 2011/0315800 A1 Dec. 29, 2011

(51) Int. Cl.
*B02C 19/00* (2006.01)

(52) U.S. Cl. ..... 241/30; 241/60; 241/159; 241/605

(58) Field of Classification Search ..... 241/30, 241/159, 605, 60, 101.2
See application file for complete search history.

(56) References Cited

U.S. PATENT DOCUMENTS 3,051,398 A * 8/1962 Babb ..... 241/136
4,381,082 A * 4/1983 Elliott et al. ..... 241/186.5
4,465,239 A * 8/1984 Woten ..... 241/98
4,951,883 A * 8/1990 Loppoli et al. ..... 241/101.762
5,217,174 A * 6/1993 Martin et al. ..... 241/222
5,622,323 A * 4/1997 Krueger et al. ..... 241/101.76
5,840,105 A 11/1998 Helmstetter
6,101,679 A 8/2000 Freund et al.
6,793,726 B1 9/2004 Yap et al.
7,967,227 B2 * 6/2011 Johnson et al. ..... 241/101.8

OTHER PUBLICATIONS

Great Plains Manufacturing, Inc. 3-Point Native Grass, Mar. 11, 2008.

* cited by examiner

*Primary Examiner* — Mark Rosenbaum
(74) *Attorney, Agent, or Firm* — Head, Johnson & Kachigian, P.C.

(57) ABSTRACT

A device for breaking up compressed masses of fibers into pieces of fiber and transporting the pieces of fiber, comprising: an intake chute; a plurality of break-up implements mounted on a plurality of shafts rotatably mounted within the intake chute; a plurality of devices with protrusions, where the plurality of devices are mounted on a plurality of shafts rotatably mounted within the intake chute; and a transportation device. A compressed mass of fibers may be placed within the intake chute, the compressed mass of fibers may come into contact with the plurality of break-up implements, the compressed mass of fibers may be broken into large pieces of fiber by the break-up implements, the larger pieces of fiber may come into contact with the plurality of devices, the larger pieces of fiber may be broken into small pieces of fiber by the devices, and the small pieces of fiber may fall onto the transportation device.

20 Claims, 2 Drawing Sheets

FIBER FEEDER

FIELD OF THE INVENTION

The present invention relates to a fiber feeder. More particularly, the present invention breaks up large, compressed masses of fibers to allow the fibers to be used in a particular application, such as in asphalt.

DESCRIPTION OF THE RELATED ART

Fibers are used in a diversity of applications. The carpeting industry uses a variety of fibers like nylon, polypropylene, polyester, and wool. Fire resistant coatings have benefitted from fiber use as described in U.S. Pat. No. 5,840,105 to Helmstretter. Fibers can be used as rheology modifiers as in 'Aqueous suspensions with bentonite for mastics and sealants' as seen in U.S. Pat. No. 6,793,726 to Yap, et al. Additionally, fibers can be added to mixtures to provide additional strength, as in tire manufacture, paints, adhesives, mastics, asphalt, and the like.

The use of virgin fibers can begin with long lengths that are reduced in size for a particular purpose. Storing, transporting, and handling these spooled fibers is efficient. Recycled fibers are recovered from a variety of applications like carpeting. Once recovered, these fibers tend to be random in orientation and loosely packed. To facilitate storage, shipping, and handling, the loose fibers are densified into compressed masses.

The use of recycled fibers and non-spooled virgin fibers requires conversion of the compressed masses of fibers into a usable form. Consistent application of fibers requires disentanglement of the compressed mass. Without disentanglement, the properties of the finished product may be inconsistent and additional fibers may be required to meet performance objectives.

Fibers are usually conveyed by a fiber-blower or vacuum. Fibers cut from larger lengths generally are transported via a blower-conveyer in a fiber-laden airstream. The fibers are random in orientation in conveyance but are generally not entangled. U.S. Pat. No. 6,101,679 to Freund, et al. describes a typical conveyer blower. This process may also be used to convey densified tufts of fibers.

Fibers can also be aligned using carding machines. These align a fiber with sufficient parallelization in a preferred orientation before spinning or other use. These processes are slow and expensive are generally used in very large milling operations.

Fibers can be used in road construction. They have the ability to provide added strength and flexibility. Fibers are used in hot mix, warm mix, and cold mix asphalt operations. The ability of the fibers to perform consistently is based on homogeneous application.

In cold mix operations, fiber is often mixed with aggregate, water, and an asphalt emulsion for use in paving. Such fiber may be stored in large compressed masses, and the compressed masses must be separated into small pieces before being mixed with the aggregate, water, and asphalt emulsion. Currently, fibers are manually pulled apart by hand or pneumatically blown to break-up the compressed masses of fiber. These techniques produce small dense tufts that are presumed to be further broken apart by processing such as by the agitation of a mixing or paving operation. A final report by the New Jersey Department of Transportation and Federal Highway Administration confirms the need for fibers to be "uniformly and consistently incorporated into the asphalt mixture". *Recycled Plastic Fibers for Asphalt Mixtures, Final Report*, New Jersey Department of Transportation (August 1999). But recycled fibers "typically obtained from recycling operations such as from carpets . . . produced waste (fiber) that was entangled," which is why "results were inconsistent" Id.

Based on the foregoing, there remains a need for a device that separates compressed masses of fiber quickly and inexpensively without tangling the fibers. Accordingly, it would be desirable to provide a device that automatically breaks up such compressed masses of fiber before transportation of the small pieces of fiber to a processing location where they may be used.

SUMMARY OF THE INVENTION

In general, in a first aspect, the present invention relates to a device for breaking up compressed masses of fibers into pieces of fiber and transporting the pieces of fiber, comprising: an intake chute; a plurality of break-up implements mounted on a plurality of shafts rotatably mounted within the intake chute; a plurality of devices with protrusions, where the plurality of devices are mounted on a plurality of shafts rotatably mounted within the intake chute; and a transportation device; such that a compressed mass of fibers may be placed within the intake chute, the compressed mass of fibers may come into contact with the plurality of break-up implements, the compressed mass of fibers may be broken into large pieces of fiber by the break-up implements, the larger pieces of fiber may come into contact with the plurality of devices, the larger pieces of fiber may be broken into small pieces of fiber by the devices, and the small pieces of fiber may fall onto the transportation device.

The device may further comprise a drive mechanism such that each of the shafts has an end that extends through a first wall of the intake chute and terminates in the drive mechanism. The drive mechanism may be a plurality of gears, where each of the shafts terminates in one of the plurality of gears. The drive mechanism may be aligned such that a linking device may be placed upon the drive mechanism, allowing rotation of the entire drive mechanism by turning any portion of the drive mechanism. The device may further comprise a linking device placed upon the drive mechanism such that turning a portion of the drive mechanism produces rotation of the entire drive mechanism. The device may further comprise a motor attached to one of the shafts such that the motor produces rotation of the shaft and the drive mechanism attached to the shaft, and thus produces rotation of the entire drive mechanism and the shafts to which the drive mechanism is attached. The drive mechanism attached to the shafts upon which the devices with protrusions are mounted may be smaller than the drive mechanism attached to the shafts upon which the break-up implements are mounted.

Each of the shafts may have an opposing end that extends through a second wall of intake chute and terminates in one of said drive mechanisms, where the second wall is parallel to the first wall. The drive mechanism on the ends of the shafts extending through the first wall may be aligned such that a linking device may be placed upon the drive mechanism, allowing rotation the entire drive mechanism by turning a portion of the drive mechanism; and the drive mechanism on the opposing ends of the shafts extending through the second wall are aligned such that a second linking device may be placed upon the drive mechanism, allowing rotation of the entire drive mechanism by turning any portion of the drive mechanism. The device may further comprise a motor attached to one of the shafts such that the motor produces rotation of the shaft and the drive mechanism attached to the shaft, and thus produces rotation the entire drive mechanism and the shafts to which the drive mechanisms are attached.

The intake chute may be substantially perpendicular such that the intake chute has an opening, the opening is located above the plurality of break-up implements, the plurality of break-up implements is located above the plurality of devices with protrusions, and the plurality of devices with protrusions is located above the transportation device. The device may further comprise a plurality of spaces between the plurality of break-up implements through which the large pieces of fiber may fall. The device may further comprise a plurality of spaces between the devices with protrusions through which the small pieces of fiber may fall. The device may further comprise a gap in the intake chute located proximate to the conveyor belt such that the small pieces of fiber may fall onto the transportation device and the transportation device may transport the small pieces of fiber out of the intake chute through the gap.

The transportation device may be a conveyor belt. The break-up implement may be a paddle. The device with protrusions may be a sprocketed wheel. The transportation device may be a pneumatic blower.

In general, in a second aspect, the present invention relates to a device for breaking up compressed masses of fibers into pieces of fiber and transporting the pieces of fiber, comprising: an intake chute where the intake chute is substantially perpendicular and has an opening; a plurality of break-up implements mounted on a plurality of shafts rotatably mounted within the intake chute and located below the opening; a plurality of devices with protrusions mounted on a plurality of shafts rotatably mounted within the intake chute and located below the plurality of break-up implements; a drive mechanism such that each of the shafts has an end that extends through a first wall of the intake chute and terminates in one of said drive mechanisms where the drive mechanisms are aligned such that a linking device may be placed upon the drive mechanism, allowing rotation the entire drive mechanism by turning any portion of the drive mechanism; a linking device placed upon the drive mechanism such that turning any portion of the drive mechanism produces rotation of all of the entire drive mechanism; a motor attached to one of the shafts such that the motor produces rotation of the shaft and the drive mechanism attached to the shaft, and thus produces rotation of all of the entire drive mechanism and the shafts to which the drive mechanisms are attached; and a transportation device located below the plurality of devices with protrusions and exiting the intake chute through a gap in the intake chute located proximate to the transportation device; such that a compressed mass of fibers may be placed within the intake chute through the opening, the compressed mass of fibers may come into contact with the plurality of break-up implements, the compressed mass of fibers may be broken into large pieces of fiber by the break-up implements, the larger pieces of fiber may come into contact with the plurality of devices with protrusions, the larger pieces of fiber may be broken into small pieces of fiber by the devices with protrusions, the small pieces of fiber may fall onto the transportation device, and the small pieces of fiber may be transported by the transportation device out of the intake chute through the gap.

The transportation device may be a conveyor belt. The break-up implement may be a paddle. The toothed or notched device may be a sprocketed wheel. The transportation device may be a pneumatic blower.

In general, in a third aspect, the present invention relates to a method of breaking up compressed masses of fibers into pieces of fiber and transporting the pieces of fiber, comprising: utilizing the device described above; starting the motor such that it rotates the drive mechanism and, consequently, the break-up implements and devices with protrusions; placing a compressed mass of fibers within the intake chute through the opening; allowing the compressed mass of fibers to fall through the intake chute until it comes into contact with the break-up implements; allowing the compressed mass of fibers to be broken into large pieces of fiber by the rotating break-up implements; allowing the large pieces of fiber to fall through the intake chute until they come into contact with the devices with protrusions; allowing the large pieces of fiber to be broken into small pieces of fiber by the rotating devices with protrusions; allowing the small pieces of fiber to fall onto the transportation device; operating the transportation device to transport the small pieces of fiber out of the intake chute through the gap and to a desired location.

DETAILED DESCRIPTION OF THE PREFERRED EMBODIMENTS

It is to be understood that the invention that is now to be described is not limited in its application to the details of the construction and arrangement of the parts illustrated in the accompanying drawings. The invention is capable of other embodiments and of being practiced or carried out in a variety of ways. The phraseology and terminology employed herein are for purposes of description and not limitation.

Figure 1:
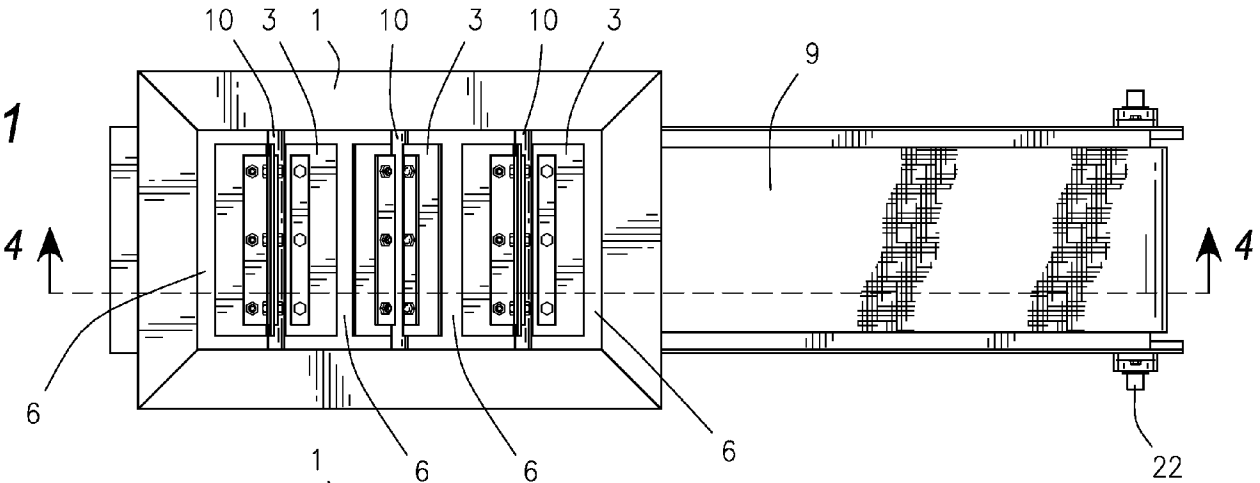
FIG. 1 is an overhead view of the fiber feeder.
Figure 2:
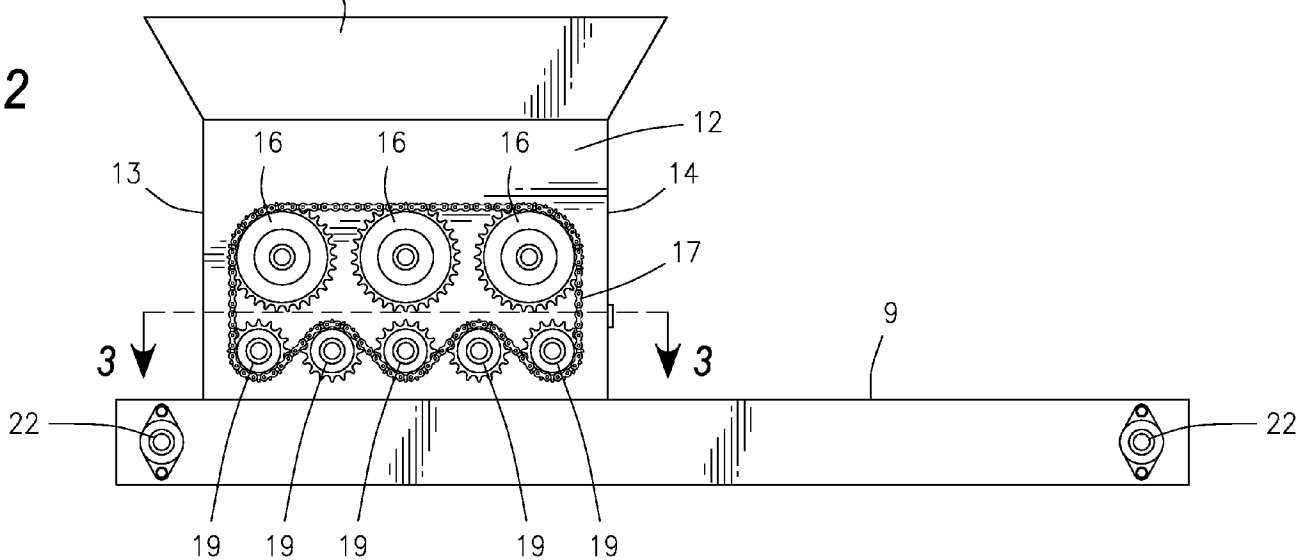
FIG. 2 is a side view of the fiber feeder.
Figure 3:
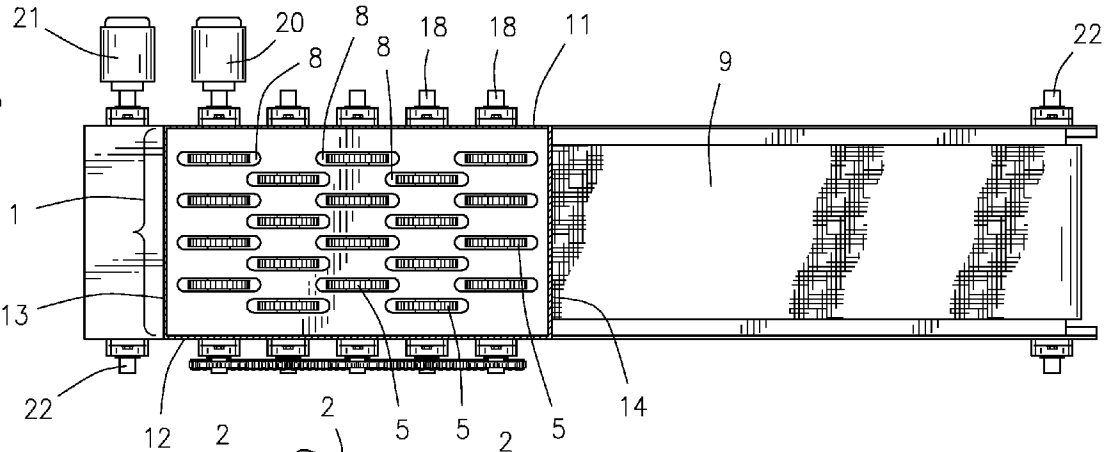
FIG. 3 is an overhead view of a cross section of the fiber feeder.
Figure 4:
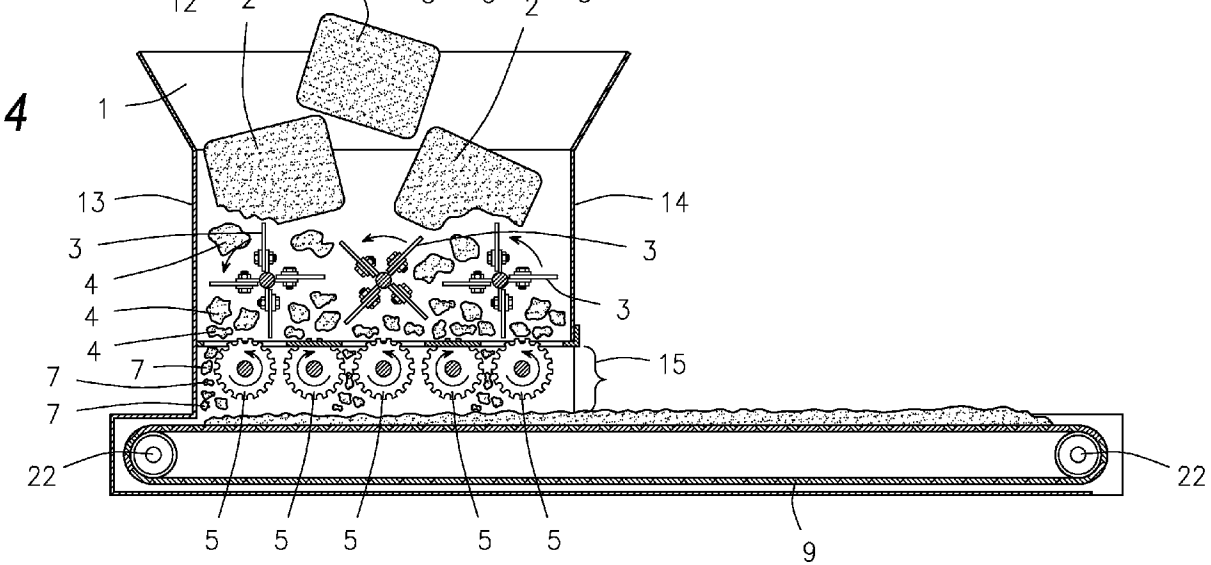
FIG. 4 is a side view of a cross section of the fiber feeder in use.

The present invention relates to a machine for separating compressed masses of fibers and transporting the fibers. The fibers may be transported by a conveyer belt, pneumatic transportation, or any other suitable transportation device. Generally, as seen in FIGS. 1 through 4, the fiber feeder has an intake chute 1 into which a compressed mass of fibers 2 may be placed. Within the intake chute 1 are one or more break-up implements 3 that rotate to break up the compressed mass 2 into large pieces 4. The break-up implements may be any suitable implements, including but not limited to paddles. Below the break-up implements 3 are one or more devices with radial or non-radial protrusions 5. The devices with radial or non-radial protrusions may be any suitable devices, including but not limited to sprockets. The large fiber pieces 4 fall through spaces 6 between the break-up implements 3 to come into contact with the devices with radial or non-radial protrusions 5. The devices with radial or non-radial protrusions 5 rotate and may further break up the large fiber pieces 4 into small fiber pieces 7. The small fiber pieces 7 fall through spaces 8 between the devices with radial or non-radial protrusions 5 and fall onto a transportation device 9, such as a conveyor belt (as shown) or other suitable transportation device. The transportation device 9 then conveys the small fiber pieces 7 to a location where they are needed for a particular application, such as mixing the fibers with a mixture of aggregate, water, and asphalt emulsion for use in paving.

The break-up implements 3 may be mounted on shafts 10, which extend between opposing walls 11 and 12 of the intake chute 1. Each of the shafts 10 may have one or more break-up implements 3 mounted thereon. The intake chute 1 may have a generally rectangular cross section, such that its opposing walls 11 and 12 are generally parallel to each other. The other walls 13 and 14 of the intake chute 1 may also be generally parallel to each other, and wall 14 may have a gap 15 in the bottom for the transportation device 9 and the small fiber pieces 7 thereon to exit the intake chute 1. The shafts 10 may extend through openings in the opposing walls 11 and 12 such that they are freely rotatable through the openings. One end of each shaft 10, such as the end extending through wall 12, may terminate in an upper drive mechanism 16. The upper drive mechanism 16 may be aligned such that a linking device 17 may be placed thereon, allowing rotation of one shaft 10 to rotate all shafts 10.

While the intake chute may have a generally rectangular cross section as described above and shown in the drawings, the intake chute may have other configurations. For example, rather than being generally parallel to each other, the walls 11, 12, 13, and 14 of the intake chute 1 may angle such that the intake chute 1 may narrow or widen from top to bottom. Similarly, the intake chute 1 may be substantially perpendicular or rather may sit at an angle.

The devices with radial or non-radial protrusions 5 may likewise be mounted on one or more shafts 18. The devices with radial protrusions 5 may be mounted on the shafts 18 such that the shafts 18 extend through the centers of the devices with radial protrusions 5, and one or more devices with radial or non-radial protrusions 5 may be located on each of the shafts 18. Similar to the shafts 10, the shafts 18 may also extend between opposing walls 11 and 12 and through openings in opposing walls 11 and 12 such that they are freely rotatable through the openings. One end of each shaft 18, such as the end extending through wall 12, may terminate in a lower drive mechanism 19. Regardless of which wall through which the drive mechanism ends of the shafts 10 and 18 extend, they may all extend through the same wall. The lower drive mechanism 19 may be aligned such that the same linking device 17 that is placed on the upper drive mechanism 16 may be placed thereon, allowing rotation of one shaft 10 to rotate not only all shafts 10 but also all shafts 18. The lower drive mechanism 19 may be smaller or larger than the upper drive mechanism 16, allowing more or less shafts 18 to be located along the same horizontal area as the shafts 10.

The linking device 17 of either the upper drive mechanism 16 or lower drive device 19 or both may be any suitable device or combination of devices. Linking devices may be, but are not limited to, belts, chains, gears, a computer controlling one or more electric, pneumatic or hydraulic motors, hydraulic oil linking one or more hydraulic motors, electrical current controlling one or more electric motors, pneumatics controlling one or more pneumatic motors, and the like. The linking devices 17 or the drive mechanism either 16 or 19 may be rotated in a sufficiently controlled manner to enable the flow of fibers 7 to the transportation device 9 in a metered manner. Optionally, the flow of fibers may be variably controlled.

If the transportation device 9 is a conveyor belt, pulley assemblies 22 may be located at both ends of the conveyor belt. A motor 21 may be attached to a pulley assembly 22 on one end of the conveyor belt, providing for movement of conveyor belt. Likewise, a motor 20 may be attached to one of the shafts 10 or one of the shafts 18, allowing rotation of all of the shafts 10 and 18, as described above. Alternately, the fibers may be transported via any other suitable transportation device, such as via pneumatic transportation. Alternately, if the device with radial or non-radial protrusions is located within sufficient proximity to the desired location of the fibers, the transportation device may be the free fall of the fibers to a processing location where they may be used.

From the above description, it is clear that the present invention is well adapted to carry out the objects and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and claimed.

What is claimed is:

1. A device for breaking up compressed masses of fibers into pieces of fiber and transporting the pieces of fiber, comprising:

an intake chute;

a plurality of break-up implements mounted on a plurality of shafts rotatably mounted within the intake chute, where the break-up implements are paddles;

a plurality of devices with protrusions, where the plurality of devices are mounted on a plurality of shafts rotatably mounted within the intake chute and where the devices with protrusions are spocketed wheels; and a transportation device;

such that a compressed mass of fibers may be placed within the intake chute, the compressed mass of fibers may come into contact with the plurality of break-up implements, the compressed mass of fibers may be broken into large pieces of fiber by the break-up implements, the larger pieces of fiber may come into contact with the plurality of devices, the larger pieces of fiber may be broken into small pieces of fiber by the devices, and the small pieces of fiber may fall onto the transportation device.

2. The device of claim 1 further comprising a drive mechanism such that each of the shafts has an end that extends through a first wall of the intake chute and terminates in the drive mechanism.

3. The device of claim 2 where the drive mechanism is a plurality of gears, where each of the shafts terminates in one of the plurality of gears.

4. The device of claim 2 where the drive mechanism is aligned such that a linking device may be placed upon the drive mechanism, allowing rotation of the entire drive mechanism by turning any portion of the drive mechanism.

5. The device of claim 4 further comprising a linking device placed upon the drive mechanism such that turning a portion of the drive mechanism produces rotation of the entire drive mechanism.

6. The device of claim 5 further comprising a motor attached to one of the shafts such that the motor produces rotation of the shaft and the drive mechanism attached to the shaft, and thus produces rotation of the entire drive mechanism and the shafts to which the drive mechanism is attached.

7. The device of claim 6 where the drive mechanism attached to the shafts upon which the devices with protrusions are mounted are smaller than the drive mechanism attached to the shafts upon which the break-up implements are mounted.

8. The device of claim 2 where each of the shafts has an opposing end that extends through a second wall of intake chute and terminates in said drive mechanism, where the second wall is parallel to the first wall.

9. The device of claim 8 where the drive mechanism on the ends of the shafts extending through the first wall are aligned such that a linking device may be placed upon the drive mechanism, allowing rotation the entire drive mechanism by turning a portion of the drive mechanism; and the drive mechanism on the opposing ends of the shafts extending through the second wall are aligned such that a second linking device may be placed upon the drive mechanism, allowing rotation of the entire drive mechanism by turning any portion of the drive mechanism.

10. The device of claim 9 further comprising a motor attached to one of the shafts such that the motor produces rotation of the shaft and the drive mechanism attached to the shaft, and thus produces rotation the entire drive mechanism and the shafts to which the drive mechanisms are attached.

11. The device of claim 1 where the intake chute is substantially perpendicular such that the intake chute has an opening, the opening is located above the plurality of break-up implements, the plurality of break-up implements is located above the plurality of devices with protrusions, and the plurality of devices with protrusions is located above the transportation device.

12. The device of claim 11 further comprising a plurality of spaces between the plurality of break-up implements through which the large pieces of fiber may fall.

13. The device of claim 12 further comprising a plurality of spaces between the devices with protrusions through which the small pieces of fiber may fall.

14. The device of claim 13 further comprising a gap in the intake chute located proximate to the transportation device such that the small pieces of fiber may fall onto the transportation device and the transportation device may transport the small pieces of fiber out of the intake chute through the gap.

15. The device of claim 1 where the transportation device is a conveyor belt.

16. The device of claim 1 where the transportation device is a pneumatic blower.

17. A device for breaking up compressed masses of fibers into pieces of fiber and transporting the pieces of fiber, comprising:

an intake chute where the intake chute is substantially perpendicular and has an opening;

a plurality of break-up implements mounted on a plurality of shafts rotatably mounted within the intake chute and located below the opening, where the break-up implements are paddles;

a plurality of devices with protrusions mounted on a plurality of shafts rotatabiy mounted within the intake chute and located below the plurality of break-up implements, where the devices with protrusions are sprocketed wheels;

a drive mechanism comprising a plurality of gears, such that each of the shafts has an end that extends through a first wall of the intake chute and terminates in one of the plurality of gears where the drive mechanisms are aligned such that a linking device may be placed upon the drive mechanism, allowing rotation the entire drive mechanism by turning any portion of the drive mechanism;

a linking device placed upon the drive mechanism such that turning any portion of the drive mechanism produces rotation of all of the entire drive mechanism;

a motor attached to one of the shafts such that the motor produces rotation of the shaft and the drive mechanism attached to the shaft, and thus produces rotation of all of the entire drive mechanism and the shafts to which the drive mechanisms are attached; and a transportation device located below the plurality of devices with protrusions and exiting the intake chute through a gap in the intake chute located proximate to the transportation device;

such that a compressed mass of fibers may be placed within the intake chute through the opening, the compressed mass of fibers may come into contact with the plurality of break-up implements, the compressed mass of fibers may be broken into large pieces of fiber by the break-up implements, the larger pieces of fiber may come into contact with the plurality of devices with protrusions, the larger pieces of fiber may be broken into small pieces of fiber by the devices with protrusions, the small pieces of fiber may fall onto the transportation device, and the small pieces of fiber may be transported by the transportation device out of the intake chute through the gap.

18. The device of claim 17 where the transportation device is a conveyor belt.

19. The device of claim 17 where the transportation device is a pneumatic blower.

20. A method of breaking up compressed masses of fibers into pieces of fiber and transporting the pieces of fiber, comprising:

utilizing the device of claim 17;

starting the motor such that it rotates the drive mechanism and, consequently, the break-up implements and devices with protrusions;

placing a compressed mass of fibers within the intake chute through the opening;

allowing the compressed mass of fibers to fall through the intake chute until it comes into contact with the break-up implements;

allowing the compressed mass of fibers to be broken into large pieces of fiber by the rotating break-up implements;

allowing the large pieces of fiber to fall through the intake chute until they come into contact with the devices with protrusions;

allowing the large pieces of fiber to be broken into small pieces of fiber by the rotating devices with protrusions;

allowing the small pieces of fiber to fall onto the transportation device;

operating the transportation device to transport the small pieces of fiber out of the intake chute through the gap and to a desired location.

* * * * *